US005323713A

United States Patent [19]

Luyk et al.

[11] Patent Number: 5,323,713

[45] Date of Patent: Jun. 28, 1994

[54] LOCKING MECHANISM FOR FOLDING TABLE LEGS

[75] Inventors: Harley E. Luyk; Gerald J. Longnecker, both of Grand Rapids, Mich.

[73] Assignee: Northwest Metal Products, Inc., Grand Rapids, Mich.

[21] Appl. No.: 921,140

[22] Filed: Jul. 29, 1992

[51] Int. Cl.[5] ..... A47B 3/08

[52] U.S. Cl. ..... 108/131; 248/188.6

[58] Field of Search ..... 108/121, 127, 131, 132, 108/133, 143, 156; 38/DIG. 1, DIG. 2, DIG. 3; 16/225; 248/188.6, 439, 166, 168, 170, 440; 211/195; 182/152, 155; 297/16.1

[56] References Cited

U.S. PATENT DOCUMENTS

| | | | |
|---|---|---|---|
| 3,096,732 | 7/1963 | Wilkinson | 108/127 |
| 3,528,377 | 9/1970 | De Saussure | 108/129 |
| 3,554,141 | 1/1971 | Burr | 108/132 |
| 3,635,172 | 1/1972 | De Saussure et al. | 108/132 X |
| 3,845,728 | 11/1974 | Piretti | 108/131 |
| 4,444,124 | 4/1984 | Burr | 108/132 X |
| 4,561,622 | 12/1985 | Heinzel | 248/439 |
| 4,573,415 | 3/1986 | Ramey | 108/129 |
| 4,827,851 | 5/1989 | Diffrient | 108/132 |
| 4,838,180 | 6/1989 | Gutgsell | 248/188.6 X |
| 4,838,181 | 6/1989 | Luyk | 108/156 |
| 4,986,195 | 1/1991 | Diffrient | 248/188.6 X |
| 5,109,778 | 5/1992 | Berkowitz et al. | 108/127 |

*Primary Examiner*—Clifford D. Crowder
*Assistant Examiner*—Ismael Izaguirre
*Attorney, Agent, or Firm*—Ian C. McLeod

[57] ABSTRACT

A locking mechanism (10) that provides for locking a table leg (12) in an extended position and a folded position. The locking mechanism is mounted to the underside of a table (14) and is comprised of a bar (90) that is pivotally mounted between right and left flanges (20, 22) of the locking mechanism. The bar has a channel (112) that provides for laterally adjusting the table leg to compensate for uneven floor contours. A first locking member (136) is controlled by an overcenter lever (126) to seat a locking rod (138) in a locking channel (102) provided on one side of the bar, opposite the lever. This provides for locking the bar and the table leg in the extended, use position. Releasing the lever enables the lever to move out of the overcenter position so that the locking rod moves out of the locking channel and the bar is able to pivot into the folded position. A second locking member (150) then engages an enlarged portion (106) of the bar and serves to block the bar in the folded position. A handle (88) portion of the second locking member provides for releasing the second locking member from the bar so that the bar can be pivoted back into the extended position. A second embodiment of the locking mechanism (200) has a length that is sufficient to provide for mounting a pair of spaced apart table leg cylinders (216, 218) comprising a table leg (224).

19 Claims, 5 Drawing Sheets

LOCKING MECHANISM FOR FOLDING TABLE LEGS

BACKGROUND OF THE INVENTION (1) Field of the Invention

The present invention relates to a locking mechanism for a table leg. In particular, the present invention relates to a mechanism for locking a table leg in an extended, use position, and in a folded position when it is desired to store the table or otherwise not use the table. The locking mechanism is secured to the underside of the table and preferably, there are at least two locking mechanisms per table, one located adjacent each end of the table.

The locking mechanism is comprised of a bar, which supports a table leg. The bar is pivotally mounted between extension portions of mating right and left flanges on a pivot bar axis, off center from the longitudinal axis of the bar. The flanges form a mounting bracket and serve to secure the mechanism to the table. To lock the bar in the extended, use position, a locking rod portion of a first locking member, which is connected to a lever, is seated in a locking channel formed on one side of the bar, spaced from the bar pivot axis and opposite a lever pivot axis. Releasing the locking rod from the channel, by moving the lever to a release position, enables the bar and table leg to pivot into the folded position. The lever serves to lock the bar in the extended position when the axis around which the connection between the first locking member and the lever rotate is moved to a position overcenter a plane connecting through the axis of the locking rod and the lever pivot axis. The locking rod is also adjustably connected to the lever so that the tension of the rod seated in the locking channel can be regulated. This ensures that the rod will always apply a sufficient force against the bar to lock the bar in the extended position.

When the lever is released, the lever moves past the overcenter position which enables the rod to move out of the locking channel. This permits the bar to pivot into the folded position. In the folded position, a second locking member engages an extension portion of the bar to block the bar from moving back into the extended position. A handle portion is used to move the second locking member away from the bar extension so that the bar is again able to be moved back into the extended position. The bar is also provided with a guideway that permits the table leg to be laterally adjusted along the length of the bar for positioning the table leg away from floor obstacles such as floor registers, electrical outlets, uneven carpeting and the like. This helps to keep the table level.

(2) Prior Art

The prior art has described various locking mechanisms that enable a table leg to be unlocked from a folded position and then moved into and locked in an extended, use position. One of these is my U.S. Pat. No 4,838,181 which describes a table leg coupling assembly that is comprised of a pivotally mounted bar having first and second recess, offset 90° from each other. A spring biased lever has a locking dog that seats in the recesses to lock the bar in either the extended or the folded position, corresponding to the first and second recesses. However, this locking mechanism is not provided with an adjusting means for regulating the tension of the locking dog in the bar recesses. As the spring controlling the locking dog loses some of its resiliency, the locking dog may have a tendency to release from the recesses. In the use position, this could cause the table to collapse, resulting in property damage as well as personal injury. It should be noted that the pivotable bar in this patent is also provided with an elongate guideway that enables the table leg to be positioned laterally along the length of the bar. This serves to position the table leg away from floor obstacles and uneven floor contours to help ensure that the table remains level while in the use position.

Another locking mechanism for a table leg is shown in U.S. Pat. No. 3,528,377 to DeSaussure. This patent describes a table leg that is locked in the extended position by the nose of a latching member which snaps into a slot provided in the table leg. U.S. Pat. No. 3,554,141 to Burr shows a table leg that is locked in the extended position by a cross bar that seats in a J-shaped groove portion of a plate connected to the table leg. U.S. Pat. No. 3,845,728 to Piretti describes a folding table leg having a releasable locking device comprising a lever arm having a hook portion that engages a similarly shaped end plate at the upper end of the table leg. U.S. Pat. No. 4,573,415 to Ramey describes a locking device where a rod blocks an extending tab portion of a plate forming a portion of a bracket that supports the table leg. U.S. Pat. No. 4,561,622 to Heinzel is less related to the present invention and describes a locking mechanism having a lever that cams against opposed cam surfaces on a locking cam plate to hold the table leg in the folded and the extended positions.

What is not shown by the prior art but is needed is a locking mechanism for a table leg that uses an overcenter locking lever connected to a locking member to lock the table leg in the extended position. That way, the locking mechanism is prevented from releasing out of the locked position unless the lever is manually moved out of the overcenter, locked position. The locking mechanism of the present invention fulfills this need and is comprised of a locking rod that seats in a locking channel of a pivotable bar to lock the bar in the extended, use position. The pivotable bar supports the table leg. The locking rod is connected to a lever that is moved to an overcenter position to lock the locking mechanism and is moved to a release position to release the locking rod from the locking channel. This enables the bar to pivot into the folded position. The locking rod is also adjustably connected to the lever so that the locking tension of the rod seated in the locking channel can be regulated. Thus, as the components forming the locking mechanism wear through use, the locking tension between the locking rod and the bar can be maintained at a sufficient force to ensure that when the pivotable bar is locked in the extended position, the locking mechanism is able to withstand a significant amount of loading and lateral forces without releasing from the extended position. Also, forming the pivotable bar with a guideway enables the table leg to be moved laterally along the length of the bar. This provides for moving the table leg away from floor obstructions and ensures that the table can be supported in a level position.

OBJECTS

It is therefore an object of the present invention to provide a locking mechanism for a table leg that provides a sturdy support which is capable of withstanding heavy loading forces and that will not release when the table is subjected to strong lateral forces, such as vibration and shaking forces. Further, it is an object of the present invention to provide an adjustable overcenter locking mechanism for a table leg that enables the locking tension between the pivotable bar supporting the table leg and a locking rod to be regulated. Still further, it is an object of the present invention to provide a locking mechanism for a table leg comprised of a pivotable bar which is locked in an extended, use position by a first locking member and that is locked in a folded position by a second locking member. Furthermore, it is an object of the present invention to provide a locking mechanism for a table leg having a pivotable bar that is locked in the extended position by an overcenter locking lever which is connected to a locking rod that seats in a locking channel provided on the bar opposite the lever. Finally, it is an object of the present invention to provide a locking mechanism for a table leg that is durable in construction, relatively inexpensive to manufacture and easy to operate. These and other objects will become increasingly apparent by reference to the following descriptions and to the drawings.

GENERAL DESCRIPTION

The present invention relates to a locking mechanism for mounting a table leg to a table means and that provide for movement of the table leg between a folded position and an extended, use position to help support the table means in the use position, which comprises: a bracket means comprising a pair of parallel and spaced apart side members depending from a base means, wherein the base means is adapted to be mounted to an underside of the table means; a bar means having spaced apart ends pivotally mounted adjacent the spaced apart side members of the bracket means and pivotably moveable between the folded and the extended positions, and having first and second sides between the ends; a lever means pivotally mounted to the bracket means, adjacent the first side of the bar means for pivotable movement about a first pivot axis; and a first locking means controlled by the lever means to lock the bar means in the extended position, wherein with the bar means in the extended position and with the lever means in a secured position, the first locking means is seated in a channel means provided on the second side of the bar means, opposite the first pivot axis of the lever means and the first side of the bar means and wherein the first locking means is connected to the lever means for rotation about a second pivot axis which is moved to a position that is overcenter a plane connecting the first locking means mounted in the channel means and the intermediate, first pivot axis of the lever means when the lever means is in the secured position to lock the bar means in the extended position, and wherein when the lever means is pivoted out of the secured position and into a release position, the first locking means pivots about the second pivot axis with respect to the lever means and moves out of the channel means so that the bar means is free to pivot between the spaced apart side members of the bracket means to move into the folded position.

IN THE DRAWINGS

FIG. 1 is a perspective view of a pair of locking mechanisms 10 according to the present invention and mounted on the underside of a table 14 to support table legs 12 in the extended position and folded position (dashed lines).

Figure 6:
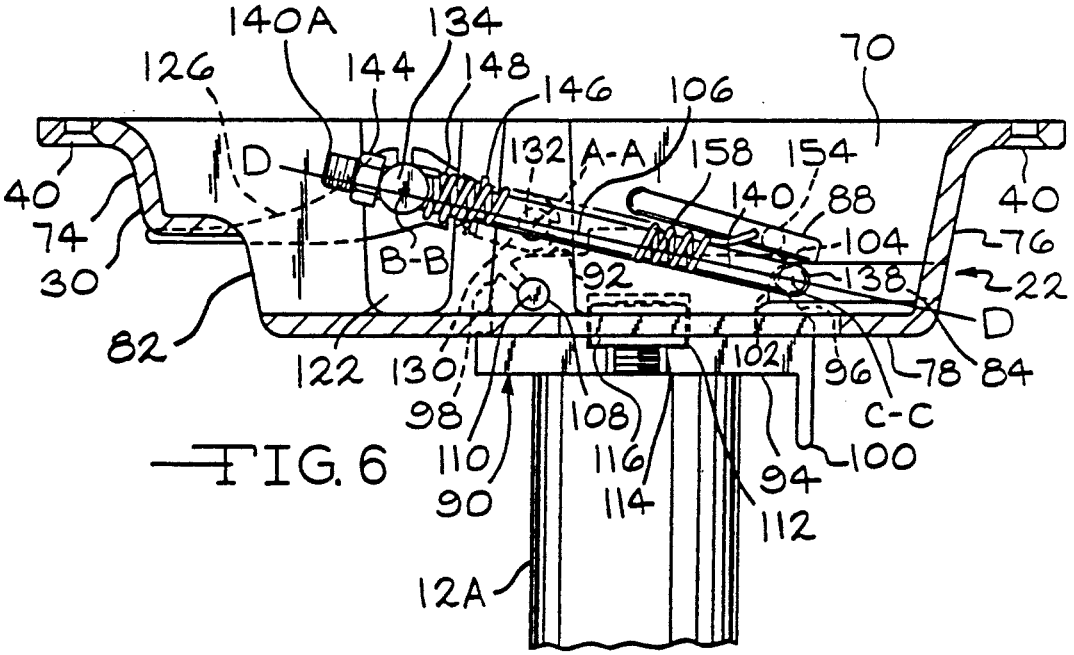
FIG. 6 is a partial cross-sectioned view along line 6—6 of FIG. 4 with the lever 126 in the overcenter position.
Figure 7:
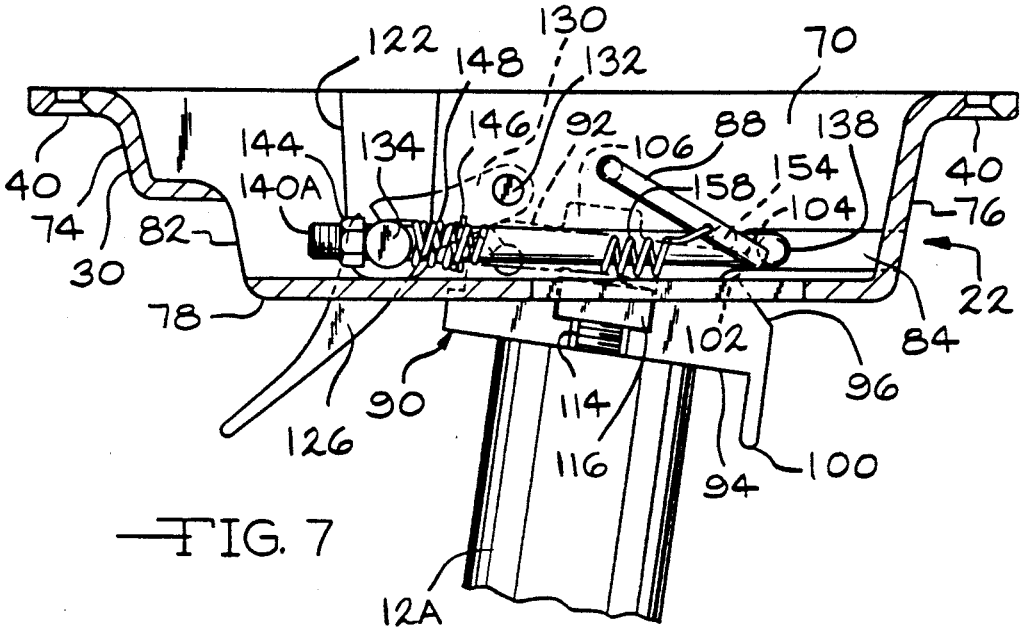

FIG. 7 is a partial cross-sectioned view along a plane similar to that shown in FIG. 6 and showing the table leg 12 supported on the pivotable bar 90 as the bar 90 is just beginning to pivot into the folded position.

Figure 8:
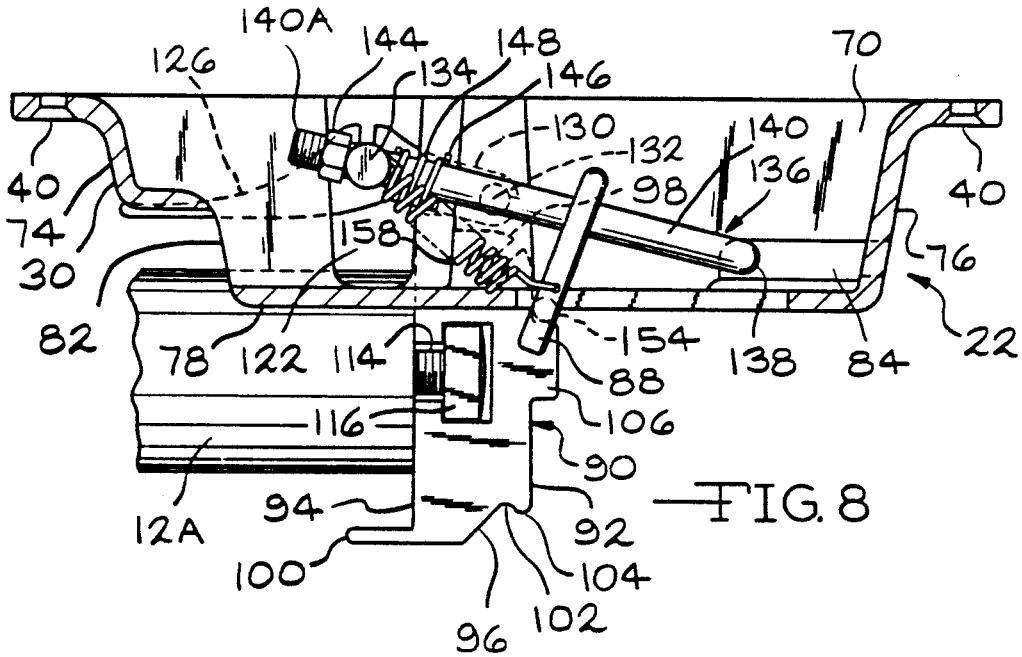

FIG. 8 is a partial cross-sectioned view along a plane similar to that shown in FIG. 6 and showing the pivotable bar 90 moved into the folded position.

Figure 9:
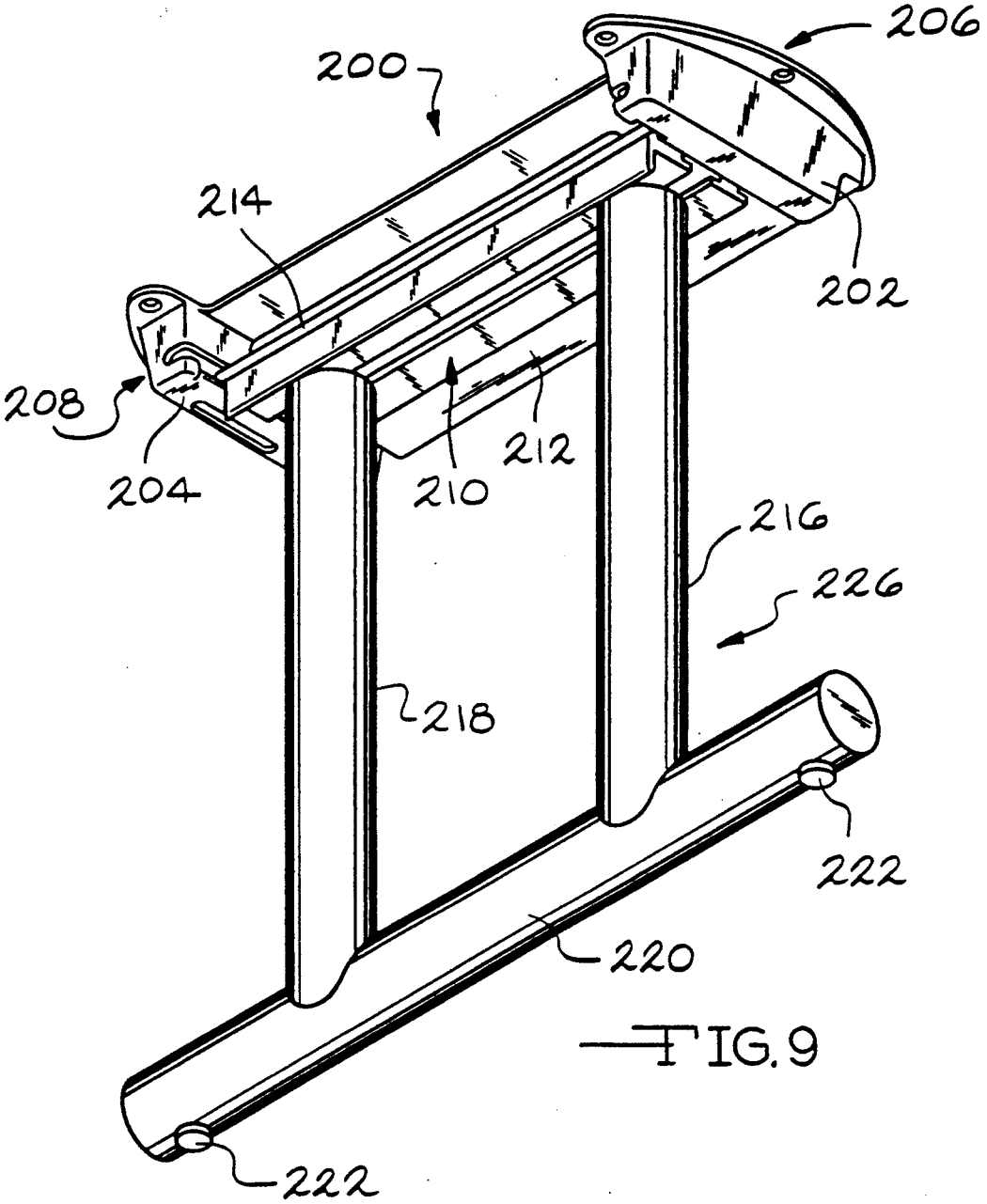

FIG. 9 is a perspective view of another embodiment of a locking mechanism 200 of the present invention.

SPECIFIC DESCRIPTION

Figure 1:
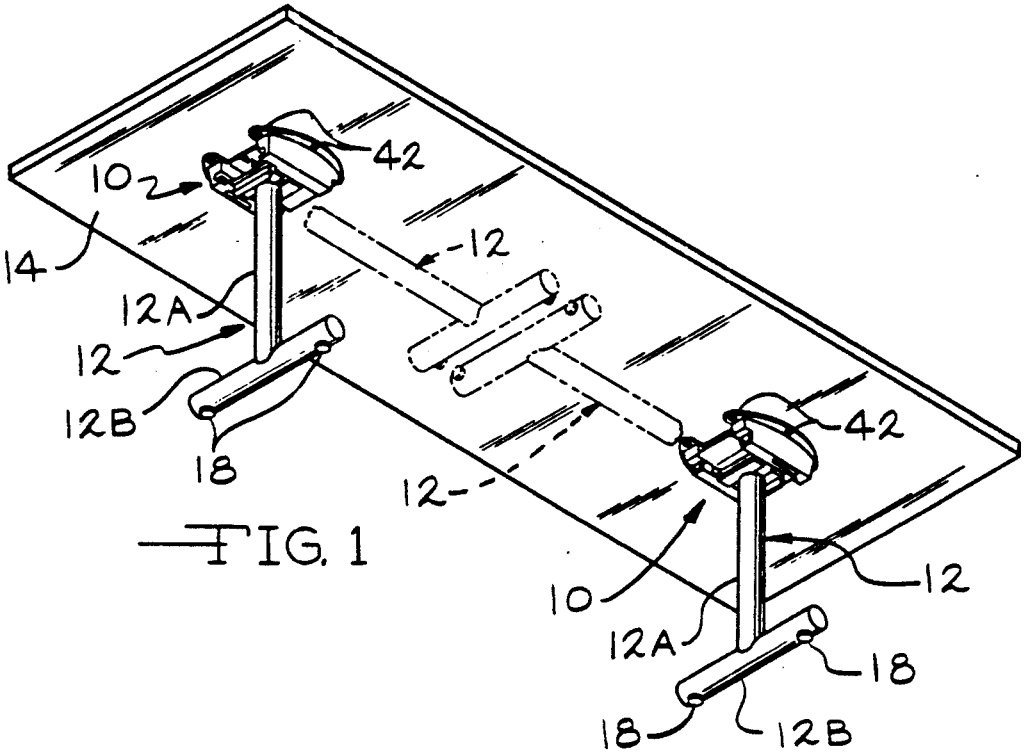

FIGS. 1 to 8 show one preferred embodiment of a locking mechanism 10 of the present invention for a table leg 12. As shown in FIG. 1, the locking mechanism 10 is a substantially metal apparatus that is mounted to the underside of a table 14 to enable its associated table leg 12 to pivot from an extended, use position, into a folded position (legs 12 shown in dashed lines). The leg 12 is a T-shaped member comprised of a main cylinder 12A having a circular plate 16 at one end (FIG. 5) and a cylindrical cross-member 12B at the opposite end. The cylindrical cross member 12B is preferably bolted (not shown) to the main cylinder 12A and adds stability to the leg 12. The cross member 12B can also be attached to the main cylinder 12A by welding or any other acceptable attachment means. The cross member 12B is further provided with a pair of spaced apart wear buttons 18 that help prevent the leg 12 from scratching a floor (not shown) when the table 14 is being used. Preferably, a pair of locking mechanisms 10 with accompanying table legs 12 are provided spaced apart on the underside of the table 14 to support the table 14 in the use position (FIG. 1).

The locking mechanism 10 is comprised of a pair of mating right and left flanges 20 and 22 forming a bracket for the locking mechanism 10. The flanges 20 and 22 are preferably made from a cast metal process. Each flange 20 and 22 includes a base plate 24 and 26 and an intermediate protrusion portion 28 and 30 between a curved outer side 32 and 34 and a generally rectangular shaped inner side 36 and 38. A plurality of openings 40 are provided around the perimeter of the curved outer sides 32 and 34 and serve to receive bolts 42 (FIG. 1) or similar attachment means for mounting the locking mechanism 10 on the underside of the table 14.

The inner side 36 of the right base plate 24 is provided with a tab 44 (FIG. 2) that mates with a recess 46 on the inner side 38 of the left base plate 26. A threaded bolt and mating nut combination 48 serve to connect the tab 44 to the recess 46. Similarly, the inner side 38 of the left base plate 26 is provided with a tab 50 (FIG. 5) that mates with a recess 52 provided on the inner side 38 of the right base plate 24. A threaded bolt and mating nut combination 54 connect the tab 50 to the recess 52, thereby connecting the right and left base plates 24 and 26 together.

Figure 2:
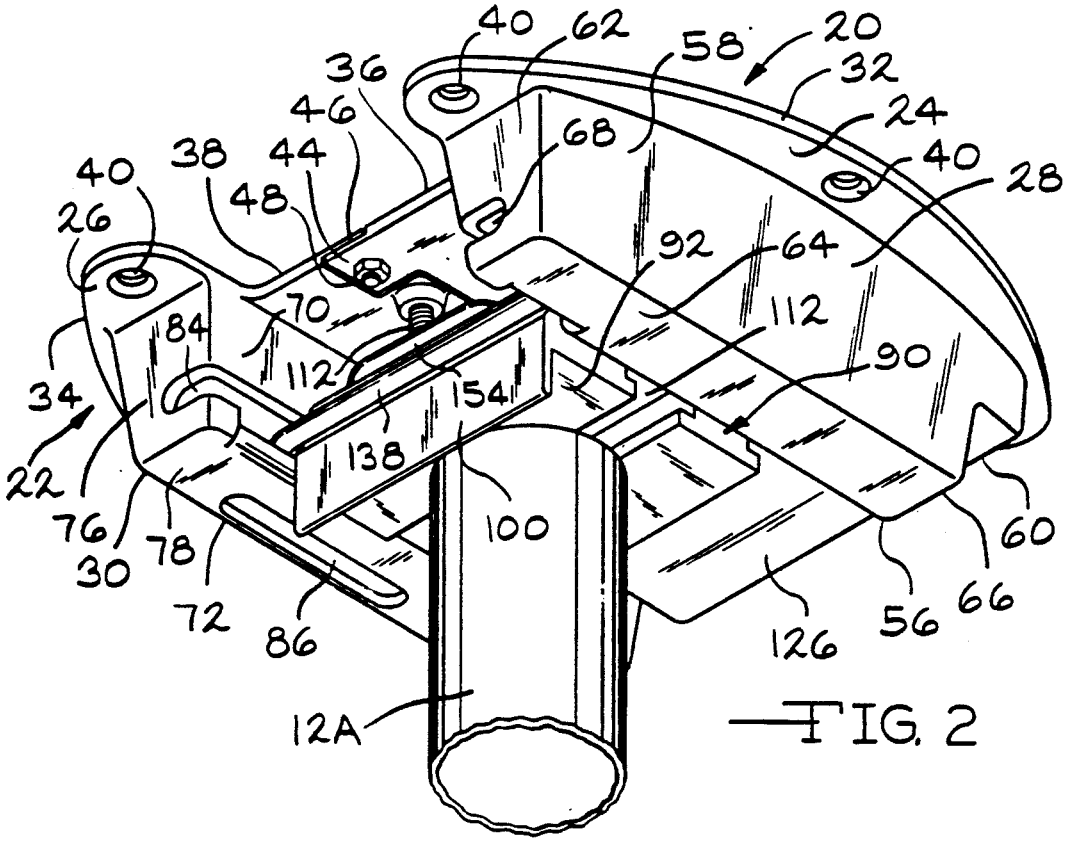
FIG. 2 is a perspective view of the locking mechanism 10 shown in FIG. 1 in the extended position.
Figure 3:
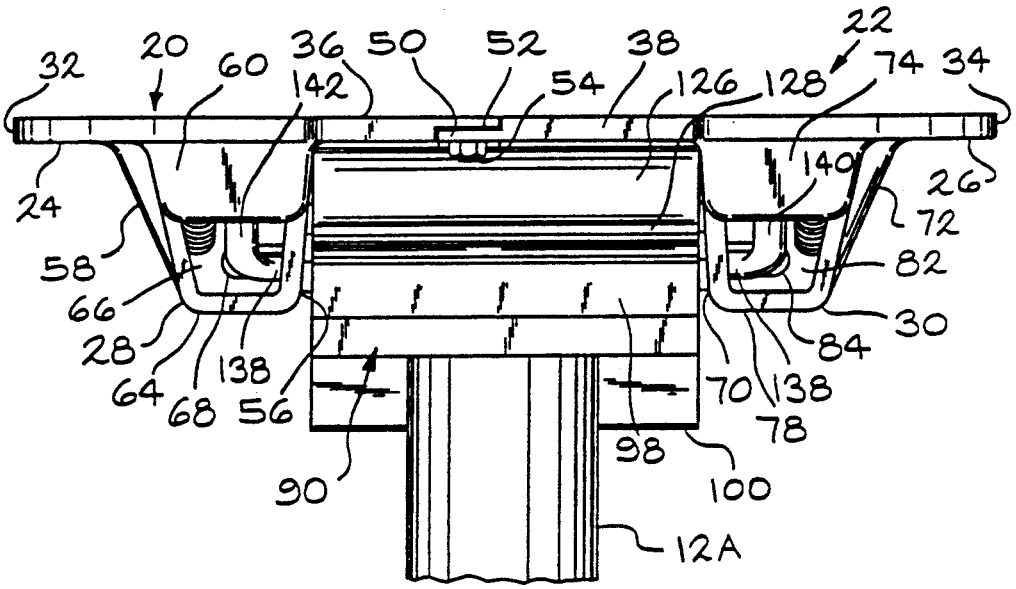
FIG. 3 is a front elevational view of the locking mechanism 10 shown in the extended position.
Figure 4:
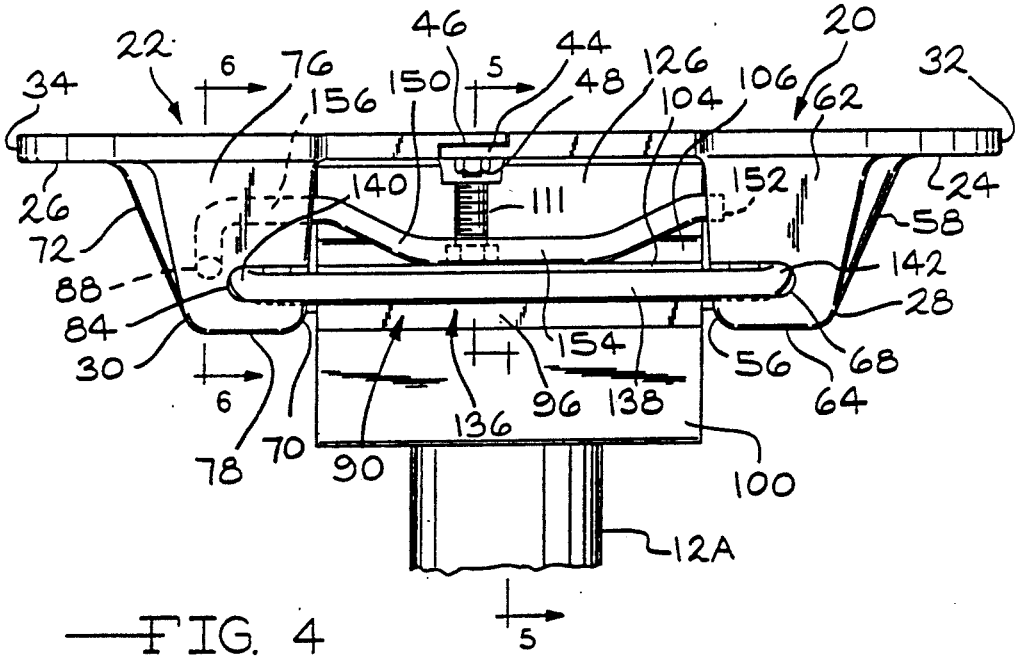
FIG. 4 is a rear elevational view of the locking mechanism 10 shown in the extended position.
Figure 5:
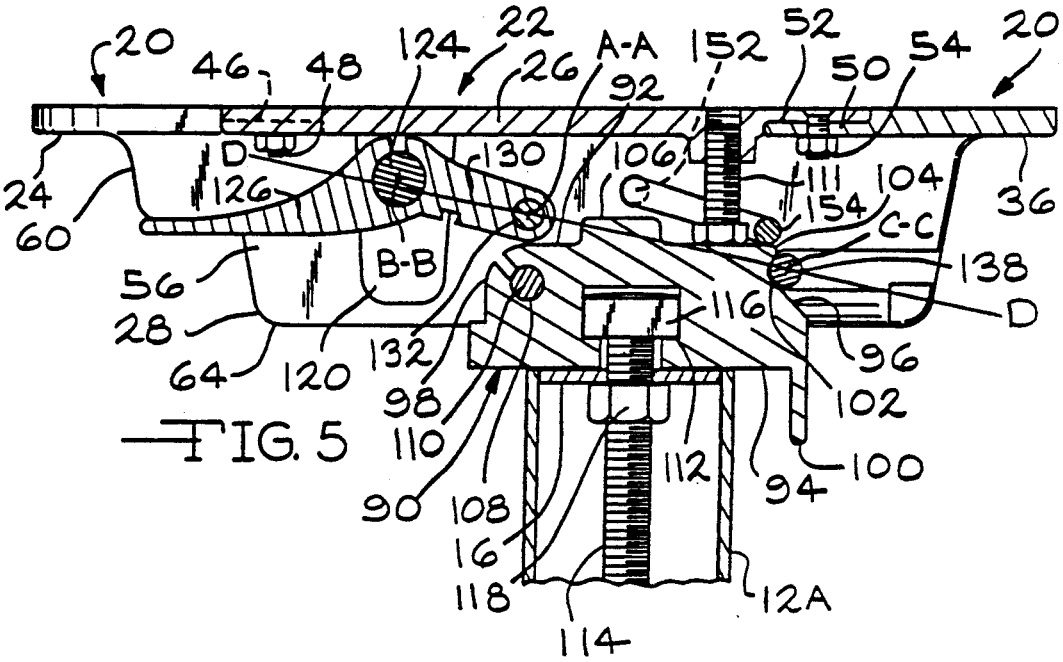
FIG. 5 is a partial cross-sectioned view along line 5—5 of FIG. 4 with the lever 126 in the overcenter position.

As particularly shown in FIGS. 2 and 5, right protrusion 28 is a generally rectangular shaped member depending downwardly from the right flange 20 and is comprised of an inner wall 56 and an outer wall 58 with opposed end walls 60 and 62 extending to a bottom wall 64. End wall 60 is formed in the shape of a step with an opening 66 (FIG. 3), adjacent the bottom wall 64. The opposite end wall 62 (FIGS. 2 and 4) is provided with an opening that extends part of the way along the inner wall 56 to form an inner L-shaped rail 68.

Similarly, left protrusion 30 of flange 22 is a generally rectangular shaped member comprised of an inner wall 70 and an outer wall 72 with opposed end walls 74 and 76 extending to a bottom wall 78. End wall 74 is a mirror image of the end wall 60 of right flange 20 and in a similar manner is formed in the shape of a step with an opening 82 (FIG. 3) adjacent the bottom wall 78. Opposed end wall 76 (FIGS. 2 and 4) is provided with an opening that extends part of the way along the inner wall 70 to form an inner L-shaped rail 84. A slot 86 (FIG. 2) extends longitudinally along the bottom wall 78, adjacent rail 84 and provides for movement of a handle 88 (FIGS. 6 to 8), as will hereinafter be described in detail.

As shown in perspective in FIG. 2, a bar member 90 is mounted between the right protrusion 28 and the left protrusion 30. Bar 90 is preferably an extruded member and as shown in cross-section (FIG. 5) is comprised of an upper face 92, a lower face 94 and a tapered side 96 and a rounded side 98. A rim 100 depends from the tapered side 96, opposite where the tapered side 96 forms into a curved surface 102 forming a channel having a lip 104. The upper face 92 is generally planar with a centrally located enlarged portion 106 extending the length of the bar 90, between the right and left protrusions 28 and 30.

The rounded side 98 has a notch leading to a bore 108. The bore 108 provides for a rod 110 that is pivotally mounted between the inner wall 70 of the left protrusion 30 and the inner wall 56 of the right protrusion 28. That way, the rod 110 enables the bar 90 to pivot between the extended position (FIGS. 2 to 6) and the folded position (FIG. 8).

As shown in FIG. 4, a height adjustment bolt 111 is threadably mounted in the base plate 26 of the left flange 22. Bolt 111 serves as a stop to regulate the extent that bar 90 can pivot on rod 110. This helps to ensure that when the bar 90 is extended, the lower face 94 remains parallel with the base plates 24 and 26 to keep the table 14 level with the floor (not shown).

A T-shaped guideway 112 is formed in the bar 90 through the lower face 94 and provides for mounting a threaded bolt 114. A head 116 of bolt 114 is mounted and retained inside the guideway 112 with the threaded bolt 114 extending through an opening in the circular end plate 16 of leg member 12A. A nut 118 is threaded down onto the bolt 114 and serves to secure the leg 12 to the bar 90. By partially unthreading the nut 118, the bolt 114 and accompanying table leg 12 can be moved laterally along the length of the guideway 112 through an infinite number of lateral adjustment positions. This ensures that when the table 14 is placed over a household floor obstacle such as a floor heating register, an electrical outlet, uneven carpeting or other similar household items, the leg 12 can be moved to avoid the floor obstacle. This helps keep the table 14 level.

As shown in FIG. 5, the inner wall 56 of right protrusion 28 is further provided with a generally rectangularly shaped opening 120 that extends from the base plate 24 to the bottom wall 64, adjacent the stepped end wall 60. Similarly, as shown in FIGS. 6 to 8, the inner wall 70 of left protrusion 30 is provided with a rectangularly shaped opening 122 that extends from the base plate 26 to the bottom wall 78, adjacent the stepped end wall 74. The rectangular openings 120 and 122 are aligned with each other and provide for movement of a cylindrically shaped, large diameter rod 124 (FIG. 5), as will hereinafter be described in detail.

As further shown in the Figures, a lever 126 is mounted between the right and left protrusions 28 and 30. The lever 126 is an extruded member and has the shape of a handle with a hinged end 130 pivotally mounted on a metal pivot rod 132 to rotate about a lever pivot axis A—A. Rod 132 extends between the inner wall 56 of the right protrusion 28 and the inner wall 70 of the left protrusion 30 and is parallel with the pivot rod 110 of bar 90. The lever 126 further provides for pivotable movement of a large diameter rod 124 having a pivot axis B—B. The large diameter rod 124 has a left end 134 (FIGS. 6 to 8) positioned between the inner and outer walls 70 and 72 of left protrusion 30 (FIGS. 6 to 8) with the length of rod 124 extending through the rectangular openings 120 and 122 to a right end (not shown). The right end of rod 124 is positioned between the inner and outer walls 56 and 58 of the right protrusion 28.

As partially shown in FIGS. 4 and 6 to 8, a first locking member 136 is mounted between the right and left flanges 20 and 22. The first looking member 136 is a metal rod member formed in a U-shape comprised of a locking rod 138 having a longitudinal axis C—C that meets with left and right leg portions 140 and 142. The locking rod 138 extends between the L-shaped rails 68 and 84 in the right and left protrusions 28 and 30 with the left leg 140 mounted through an opening in the left end 134 of the large diameter rod 124 and extending to a threaded end 140A. The threaded end 140A is provided with a nut 144 that serves to connect the left leg 140 to the large diameter rod 124. Similarly, the right leg 142 of the first locking member 136 extends from the locking rod 138 through an opening in the right end of the large diameter rod 124 to a threaded end, secured to the rod 124 by a nut (not shown). In this position, the left leg 140 of the locking member 136 is between the inner and outer walls 70 and 72 of the left protrusion 30 and the right leg 142 is between the inner and outer walls 56 and 58 of the right protrusion 28. To lock the table leg 12 in the extended position (FIGS. 5 and 6), the locking rod 138 is seated in the channel 102 on the tapered side 96 of bar 90 with the lever 126 having moved the large diameter rod 124 to a position so that the axis B—B of rod 124 is overcenter the plane D—D connecting the pivot axis A—A of rod 132 and axis C—C of the locking rod 138. The lip 104 on bar 90 helps to hold the locking rod 138 in place so that the bar 90 is not able to release from the extended position.

A roll pin 146 is mounted through the left leg 140 of the locking member 136, spaced towards the locking rod 138. A spring 148 is retained on the leg 140 by the roll pin 146 and the large diameter rod 124. The spring 148 holds the locking member 136 in tension with respect to the large diameter rod 124 and together with nut 144 provides an adjustment means to regulate the tension of the first locking member 136 against the bar 90. The right leg 142 of locking member 136 is provided with a similar roll pin, spring and nut (not shown) that serve a similar purpose. That way, the tension of the locking rod 138 of the first locking member 136 is adjustable in the channel 102 of bar 90 when the bar 90 is in the extended position.

As shown in FIG. 4, a second locking member 150 serves to lock the bar 90 in the folded position (FIG. 8). The second locking member 150 is formed from a metal rod and has a right end 152 (shown in dashed lines) pivotally mounted through the inner wall 56 of the right protrusion 28. The right end 152 extends to a central, downwardly bent portion 154 that leads to a left end 156, pivotally mounted through the inner wall 70 of the left protrusion 30. The left end 156 in turn extends to the handle 88 (FIG. 4) with the right and left ends 152 and 156 pivoting along an axis that is parallel with and spaced from the pivot axis of bar 90 and the pivot axis of the lever 126. Finally, a spring 158 (FIG. 8) is tensioned between the handle 88 and the left end 134 of the large diameter rod 124. Spring 158 serves to actuate the second locking member 150 so that the bent portion 154 is moved against the enlarged portion 106 of bar 90 to hold the bar 90 in the folded position (FIG. 8), as will hereinafter be described in detail.

IN USE

There are preferably at least two locking mechanisms 10 with associated legs 12 mounted spaced apart on the underside of the table 14. In the extended position (FIG. 1), the locking mechanisms 10 hold the legs 12 perpendicular to the table 14 to provide a sturdy support that will not collapse under heavy loading or lateral shaking forces.

The operation of the locking mechanism 10 is shown in sequence in FIGS. 6 to 8 and will be described with respect to the left flange 22 as shown. It should be understood that the right flange 20 is a virtual mirror image of the left flange 22 and except where noted, the functioning of the locking mechanism 10 when described with respect to the left flange 11 is also applicable to the right flange 20.

To move the locking mechanism 10 from the extended position (solid lines in FIG. 1) to the folded position (dashed lines in FIG. 1), a user pulls down on the lever handle 126 to move the lever 126 out of the secure position (FIG. 6) and into the release position (FIG. 7). This causes the lever 126 to pivot on the pivot rod 132, away from the base plate 26. As this happens, the large diameter rod 124 moves along the rectangular opening 122 in the left inner wall 70 of the left protrusion 30. Once the axis B—B of rod 124 has moved out of the overcenter position and crossed over the plane D—D, connecting the pivot axis A—A of rod 132 and axis C—C of the locking rod 138, the lever 126 is moved out of the secured position. As shown in FIG. 7, the extent of the pivotable movement of lever 126 is complete when the large diameter rod 124 has moved to a position adjacent the bottom wall 78 of the left protrusion 30. As the large diameter rod 124 moves, the U-shaped, first locking member 136 advances along the rail 84 towards the end wall 76. This enables the locking rod 138 of the locking member 136, to move out of channel 102 on the tapered side 96 of bar 90. With the large diameter rod 124 moved to a position adjacent the bottom wall 78 of left protrusion 30, the locking member 136 has cleared the lip 104 on the tapered side 96 of bar 90.

This releases the bar 90 from the first locking member 136 so that the bar 90 can pivot on the pivot rod 110 into the folded position (FIG. 8). As the bar 90 pivots, the spring 158 tensioned between the left end 134 of the large diameter rod 124 and the handle 88 pulls the second locking member 150 towards the bar 90. When the bar 90 is completely moved into the folded position, the bent portion 154 of the second locking member 50 engages the enlarged portion 106 extending from the upper face 92 of bar 90.

The bar 90 is now unable to pivot out of the folded position because the force created by the bar 90 against the second locking member 150 is directed against the inner walls 56 and 70 of the right and left protrusions 28 and 30 and in a direction away from the bar 90. Also, when the second locking member 150 is raised to engage and lock the bar 90 in the folded position, the handle 88 is raised in the slot 86 to a position extending above the bottom wall 78 of the left protrusion 30.

To unlock the bar 90 from the folded position, the handle 88 is moved in the slot 86 towards the end wall 76. This causes the bent portion 154 of locking rod 150 to move away from the enlarged portion 106 of the bar 90. The bar 90 is now able to pivot on the pivot rod 110, back to the fully extended position. As the bar 90 pivots, the upper face 92 of the bar 90 moves the second locking rod 150 towards the left base plate 26 of the flange 22 and against the tension of the spring 158. This causes the handle 88 to recess in the slot 86 to hide the handle 88.

With the bar 90 rotated to a position just short of fully extended, the lever 126 is moved downwardly, away from the base plate 26. This causes the large diameter rod 124 to move in the rectangular opening 122 with the first locking member 136 moving along the rail 84, as has been previously described. This enables the lip 104 of bar 90 to clear the locking rod 138 of the locking member 136 so that the bar can be fully extended. The lever 126 is then moved back towards the base plate 26, causing the large diameter rod 124 to move in the rectangular opening 122 and the locking member 136 to move along rail 84 until the locking rod 138 of locking member 136 is positioned in the channel 102 adjacent to lip 104. The locking rod 138 is locked in channel 102 when the lever 126 has moved the large diameter rod 124 to a position with the axis B—B of rod 124 overcenter plane D—D connecting the pivot axis A—A of rod 132 and axis C—C of the locking rod 138. The bar 90 is now locked in the fully extended position.

FIG. 9 shows a second embodiment of a preferred locking mechanism 200 of the present invention. Locking mechanism 200 is similar in every respect to the locking mechanism 10 shown in FIGS. 1 to 8 except that the right and left protrusions 202 and 204 of flanges 206 and 208 are spaced apart a greater distance. This requires that bar 210, lever 212 and the associated first and second locking members (only first locking member 214 is shown) have a length that is sufficiently long to provide for mounting a pair of spaced apart table leg cylinders 216 and 218 on bar 210. A single cross member 220 with spaced apart wear buttons 222 is mounted on the cylinders 216 and 218 to complete the table leg 224. Locking member 200 is preferred when the table (not shown) has a particularly large width to provide stability for the table.

It is intended that the foregoing descriptions be only illustrative of the present invention and that the present invention be limited only by the hereinafter appended claims.

I claim:

1. A mechanism for mounting a table leg to a table means and that provides for movement of the table leg between a folded position and an extended, use position to help support the table means and lock the table leg in the use position, which comprises:

(a) a bracket means comprising a pair of parallel and spaced apart side members and a base means wherein the side members extend from the base means, wherein the base means is to be mounted to an underside of the table means;

(b) a bar means having spaced apart ends pivotally mounted adjacent the spaced apart side members of the bracket means and pivotably moveable between the folded and the extended positions, having first and second sides between the ends and having an upper face and a lower face between the first and second sides wherein the lower face of the bar means has an attachment means for connecting the table leg;

(c) a lever means having a first pivot axis and a second pivot axis pivotally mounted to the bracket means, adjacent the first side of the bar means for pivotable movement about the first pivot axis; and (d) a first locking means controlled by the lever means to lock the bar means in the extended position, wherein with the bar means in the extended position and with the lever means in a secured position, the first locking means is seated in a channel means provided on the second side of the bar means, opposite the first pivot axis of the lever means and the first side of the bar means and wherein the first locking means is connected to the lever means for rotation about the second pivot axis of the lever means wherein the second pivot axis is moved to a position that is overcenter a plane connecting the first locking means mounted in the channel means and the first pivot axis of the lever means when the lever means is in the secured position to lock the bar means in the extended position, and wherein when the lever means is pivoted out of the secured position and into a release position, the first locking means pivots about the second pivot axis with respect to the lever means and moves out of the channel means so that the bar means is free to pivot between the spaced apart side members of the bracket means to move into the folded position.

2. The mechanism of claim 1 wherein the bar means supports at least one table leg and wherein with the bar means in the extended position, the table leg is perpendicular with respect to the underside of the table means to help support the table means in the use position.

3. The mechanism of claim 1 wherein the bar means pivots towards the lever means when the bar means moves from the extended position to the folded position.

4. A mechanism for mounting a table leg to a table means and that provides for movement of the table leg between a folded position and an extended, use position to help support the table means and lock the table leg in the use position, which comprises:

(a) a bracket means comprising a pair of parallel and spaced apart side members and a base means wherein the side members extend from the base means, wherein the base means is to be mounted to an underside of the table means;

(b) a bar means having spaced apart ends pivotally mounted adjacent the spaced apart side members of the bracket means and pivotably moveable between the folded and the extended positions, having first and second sides between the ends wherein the bar means is an extruded member having an upper face and a lower face between the first and second sides and wherein the lower face has a guideway for mounting a shaft means having an enlarged portion retained within the guideway and with the shaft means extending from the lower face of the bar means for connecting the table leg to the bar means;

(c) a lever means having a first pivot axis and a second pivot axis pivotally mounted to the bracket means, adjacent the first side of the bar means for pivotable movement about the first pivot axis of the lever means; and (d) a first locking means controlled by the lever means to lock the bar means in the extended position, wherein with the bar means in the extended position and with the lever means in a secured position, the first locking means is seated in a channel means provided on the second side of the bar means, opposite the first pivot axis of the lever means and the first side of the bar means and wherein the first locking means is connected to the lever means for rotation about the second pivot axis of the lever means wherein the second pivot axis is moved to a position that is overcenter a plane connecting the first locking means mounted in the channel means and the first pivot axis of the lever means when the lever means is in the secured position to lock the bar means in the extended position, and wherein when the lever means is pivoted out of the secured position and into a release position, the first locking means pivots about the second pivot axis with respect to the lever means and moves out of the channel means so that the bar means is free to pivot between the spaced apart side members of the bracket means to move into the folded position.

5. The mechanism of claim 4 wherein a length of the guideway in the bar means allows for adjustably mounting the table leg along the length of the guideway in the bar means.

6. The mechanism of claim 5 wherein the base means of the bracket means is provided with an adjustable stop means and wherein when the bar means is in the extended position, the stop means ensures that the upper face of the bar means is parallel with the base means of the bracket means so that the table leg mounted on the bar means supports the table in a horizontal plane as the use position.

7. The mechanism of claim 1 wherein the base means of the bracket means is comprised of a pair of base plates having tabs and recesses that mate together to form the bracket means and wherein each of the plates has one of the side members to form the bracket means when the pair of base plates are mated together.

8. The mechanism of claim 1 wherein the first locking means is adjustable relative to the channel means of the bar means when the bar means is locked in the extended position by the first locking means.

9. The mechanism of claim 8 wherein the lever means has opposed pivot extensions that extend through opposed side openings in the spaced apart side members, adjacent the bar means wherein the first locking means is a U-shaped rod means having a base portion and opposed legs that connect to the opposed pivot extensions of the lever means, adjacent the side openings in the side members of the bracket means and wherein with bar means locked in the extended position, the base portion of the rod means is mounted in the channel means provided on the bar means for locking the bar means in the extended position.

10. The mechanism of claim 9 wherein the opposed legs of the rod means mount through respective openings in the pivot extensions of the lever means with a retainer means and an intermediate, first resilient means mounted on the legs of the rod means, towards the base portion of the rod means of the first locking means and wherein an adjustment means is mounted on an end of the legs, opposite the first resilient means for adjusting the tension of the first resilient means on the legs of the rod means and against the pivot extensions of the lever means to adjust the position of the base portion of the rod means relative to a seat in the channel means of the bar means to lock the bar means in the extended position.

11. The mechanism of claim 10 wherein the side members of the bracket means each comprise housing means having a surrounding sidewall and a closing end wall with the sidewall extending from the base means to the closing end wall of the housing means and wherein the opposed pivot extensions of the lever means extend through the opposed side openings, which are provided in an inner portion of the sidewalls of the housing means, with the opposed pivot extensions positioned inside the housing means.

12. The mechanism of claim 11 wherein an end portion of the sidewalls of the housing means of the bracket means has openings adjacent the adjustment means mounted on the legs of the rod means comprising the first locking means for accessing the adjustment means to regulate the tension of the first resilient means mounted on the legs and against the pivot extensions of the lever means to adjust the position of the base portion of the rod means mounted in the channel means in the bar means to lock the bar means in the extended position.

13. The mechanism of claim 9 wherein the lever means is pivotally mounted adjacent the opposed side members of the bracket means at an intermediate position between the bar means and the pivot extensions of the lever means and wherein the lever means pivots towards the bar means to unlock the bar means from the extended position by moving the opposed pivot extensions in the opposed side openings of the side members to move the opposed legs of the rod means comprising the first locking means towards the bar means with the base portion of the rod means moving out of the channel means in the bar means so that the bar means is capable of pivoting between the extended and the folded positions.

14. The mechanism of claim 1 wherein the bar means is an extruded member with the upper face adjacent and parallel with the base means of the bracket means when the bar means is in the extended position and wherein when the bar means pivots into the folded position, the upper face of the bar means is substantially perpendicular to the base means.

15. A mechanism for mounting a table leg to a table means and that provides for movement of the table leg between a folded position and an extended, use position to help support the table means and lock the table leg in the use position, which comprises:

(a) a bracket means comprising a pair of parallel and spaced apart side members and a base means wherein the side members extend from the base means, wherein the base means is to be mounted to an underside of the table means;

(b) a bar means having spaced apart ends pivotally mounted adjacent the spaced apart side members of the bracket means and pivotably moveable between the folded and the extended positions, having first and second sides between the ends;

(c) a lever means having a first pivot axis and a second pivot axis pivotally mounted to the bracket means, adjacent the first side of the bar means for pivotable movement about the first pivot axis; and (d) a first locking means controlled by the lever means to lock the bar means in the extended position, wherein with the bar means in the extended position and with the lever means in a secured position, the first locking means is seated in a channel means provided on the second side of the bar means, opposite the first pivot axis of the lever means and the first side of the bar means and wherein the first locking means is connected to the lever means for rotation about the second pivot axis of the lever means wherein the second pivot axis is moved to a position that is overcenter a plane connecting the first locking means mounted in the channel means and the first pivot axis of the lever means when the lever means is in the secured position to lock the bar means in the extended position, and wherein when the lever means is pivoted out of the secured position and into a release position, the first locking means pivots about the second pivot axis with respect to the lever means and moves out of the channel means so that the bar means is free to pivot between the spaced apart side members of the bracket means to move into the folded position and wherein a second locking means having a blocking portion is pivotally mounted to the spaced apart side members of the channel means and wherein when the bar means pivots from the extended position and into the folded position, the second locking means pivots on the channel means with the blocking portion of the second locking means moving against the bar means to retain the bar means in the folded position.

16. The mechanism of claim 15 wherein the bar means has an upper face and a lower face between the first and second sides with the upper face adjacent and parallel with the base means of the bracket means when the bar means is in the extended position and wherein the blocking portion of the second locking means moves against an enlarged portion on the upper face of the bar means to retain the bar means in the folded position.

17. The means of claim 15 wherein the second locking means is provided with a resilient means that automatically moves the blocking portion against the bar means to retain the bar means in the folded position.

18. The mechanism of claim 17 wherein the second resilient means is a coil spring means.

19. The mechanism of claim 15 wherein the side members of the bracket means each comprise housing means having a surrounding sidewall and a closing bottom wall with the sidewall extending from the base means to the closing bottom wall of the housing means and the second locking means has a handle means housed within one of the housing means of the bracket means when the bar means is in the extended position so that when the bar means moves into the folded position, the handle means is capable of moving in a slot in the bottom wall of the one housing means to extend beyond the bottom wall and wherein with the second locking means holding the bar means in the folded position, the handle means enables the blocking portion of the second locking means to be moved away from the bar means to release the bar means so that the bar means is capable of pivoting into the extended position.

* * * * *